US007611378B1

(12) United States Patent
Brekosky et al.

(10) Patent No.: US 7,611,378 B1
(45) Date of Patent: Nov. 3, 2009

(54) ROTATIONALLY ADJUSTABLE CONNECTOR ASSEMBLY

(75) Inventors: Lawrence John Brekosky, Dillsburg, PA (US); Ricardo Lee Koller, Lititz, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/238,483

(22) Filed: Sep. 26, 2008

(51) Int. Cl.
*H01R 3/00* (2006.01)

(52) U.S. Cl. ..... 439/500

(58) Field of Classification Search ..... 439/500, 439/481, 466, 191, 701, 535, 350, 357
See application file for complete search history.

(56) References Cited

U.S. PATENT DOCUMENTS 4,619,496 A * 10/1986 Forney et al. ..... 439/434
5,611,707 A * 3/1997 Meynier ..... 439/353
7,207,844 B2 * 4/2007 Peng ..... 439/640

OTHER PUBLICATIONS

TYCO Electronics Corporation, Push-pull latch medical circular plastic connectors (M-CPC), Application Specification 114-13184, Nov. 12, 2007, pp. 1-9, Rev C.
TYCO Electronics Corporation, Miniature circular plastic connector (CPC), Application Specification 114-13105, Sep. 16, 2003, pp. 1-13, REV O.
TYCO Electronics Corporation, Assembly Plug Size 11,6 Position, Sealed Mini CPC, Engineer Drawing, dated Jun. 2003 as downloaded Sep. 30, 2008 at http://catalog.tycoelectronics.com/TE/bin/TE.Connect?C=1&M=BYPN&PID=197533&PN=1445819-1.

* cited by examiner

*Primary Examiner*—Phuong K Dinh

(57) ABSTRACT

A rotationally adjustable connector assembly is disclosed. The connector assembly includes a connector housing, a base and a latch connected to the connector housing and the base. The latch is connected at a fixed position with respect to the connector housing. The base is co-axial with the latch, the base and the latch being configured to permit the base to rotate about the latch, such that the base is thereby rotationally adjustable with respect to the connector housing.

18 Claims, 5 Drawing Sheets

ROTATIONALLY ADJUSTABLE CONNECTOR ASSEMBLY

FIELD OF THE INVENTION

The present invention is directed to electrical connectors and more particularly to a connector assembly that is rotationally adjustable for use in medical and other applications.

BACKGROUND OF THE INVENTION

Various safety and sanitary concerns generally require that many instruments and equipment for various medical and dental procedures are utilized for a single patient or a single event and then disposed of. However, not all equipment can or should be disposed of after a single use because of its sophistication and associated expense.

For example, equipment such as scalpels, cauterizers, and other surgical tools are brought into contact with the patient and are ordinarily discarded, although a power source or instrumentation used with the tool may be readily sterilizable and/or sufficiently removed from the patient and associated hazards to permit re-use. The reusable instrumentation may include a plug and cable that is readily and easily attached to the disposable tool with a connector assembly. The plug and cable provide a connection between the disposable tool and the power source and/or sophisticated electronic equipment.

However, because tools (e.g., a knife) often have a working feature (e.g., the blade) fixed in a particular orientation, a tool must ordinarily be manipulated and handled so that the working feature of a tool designed for a particular task can accomplish that task. This problem can become particularly cumbersome in surgical environments where surgeons must often rotate their arm or wrist to obtain a desired blade position. This can in turn be an uncomfortable or unnatural position, but one which must be maintained for long periods of time during surgery, leading to fatigue. Furthermore, manipulating tools connected to the cords and tubing often present in medical applications can introduce twisting or other undesirable situations that can disrupt concentration and otherwise needlessly complicate the surgical procedure.

Also, surgical environments are often wet, which can create the possibility of malfunction as a result of interference with electrical connections.

These and other drawbacks are found in current connectors.

What is needed is a connector assembly that permits the orientation of a tool or other device to be modified while alleviating the amount of rotation or other strain on the part of one using the tool.

What is also needed is a connector assembly that permits operation in a wet environment, such as allowing fluid to flow internally through the connector assembly while sealing electrical connections from a wet environment.

SUMMARY OF THE INVENTION

According to an exemplary embodiment of the invention, a rotationally adjustable connector assembly is disclosed. The connector assembly includes a connector housing, a base and a latch connected to the connector housing and the base. The latch is connected at a fixed position with respect to the connector housing and the base is co-axial with the latch. The base and latch are configured to permit the base to rotate about the latch, such that the base is thereby rotationally adjustable with respect to the connector housing.

According to another exemplary embodiment of the invention, a rotationally adjustable connector assembly includes a connector housing, a base, a latch connected to the connector housing and the base. The connector assembly also includes a plug insert positioned within the latch. The plug insert has a plurality of contacts for accomplishing an electrical connection between a tool attached to a first end of the connector assembly and a device body attached to a second end of the connector assembly; the plug assembly also has an enclosed channel to provide a fluid path passing internal the connector assembly. The latch is connected at a fixed position with respect to the connector housing and the base is co-axial with the latch. The base and latch are configured to permit the base to rotate about the latch in predetermined increments, such that the base is thereby rotationally adjustable with respect to the connector housing.

An advantage of certain exemplary embodiments described herein is that a connector assembly is provided that is rotationally adjustable to one of a plurality of indexed locations.

Another advantage is that certain exemplary embodiments described herein provide a connector assembly that is rotationally adjustable while accommodating a fluid line that passes through the connector assembly.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Figure 1:
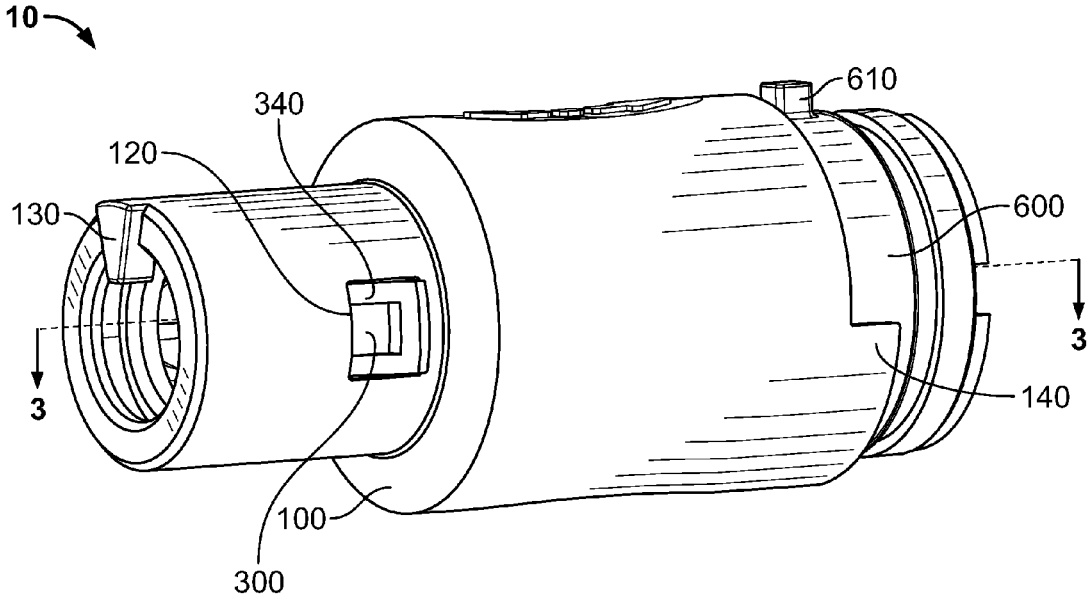
FIG. 1 illustrates a perspective view of a connector assembly in accordance with an exemplary embodiment of the invention.

Referring to FIG. 1, a connector assembly 10 is shown. The connector assembly 10 includes a connector housing 100 and a base 600. The connector housing 100 and base 600 are rotationally adjustable with respect to one another via a latch 300 (better seen in FIG. 2) to which each of the connector housing 100 and the base 600 are connected. The latch 300 is connected at a fixed position with respect to the housing 100. The base 600 is co-axial with the latch 300 and the two are connected to one another such that the base 600 can rotate about the latch 300.

Figure 5:
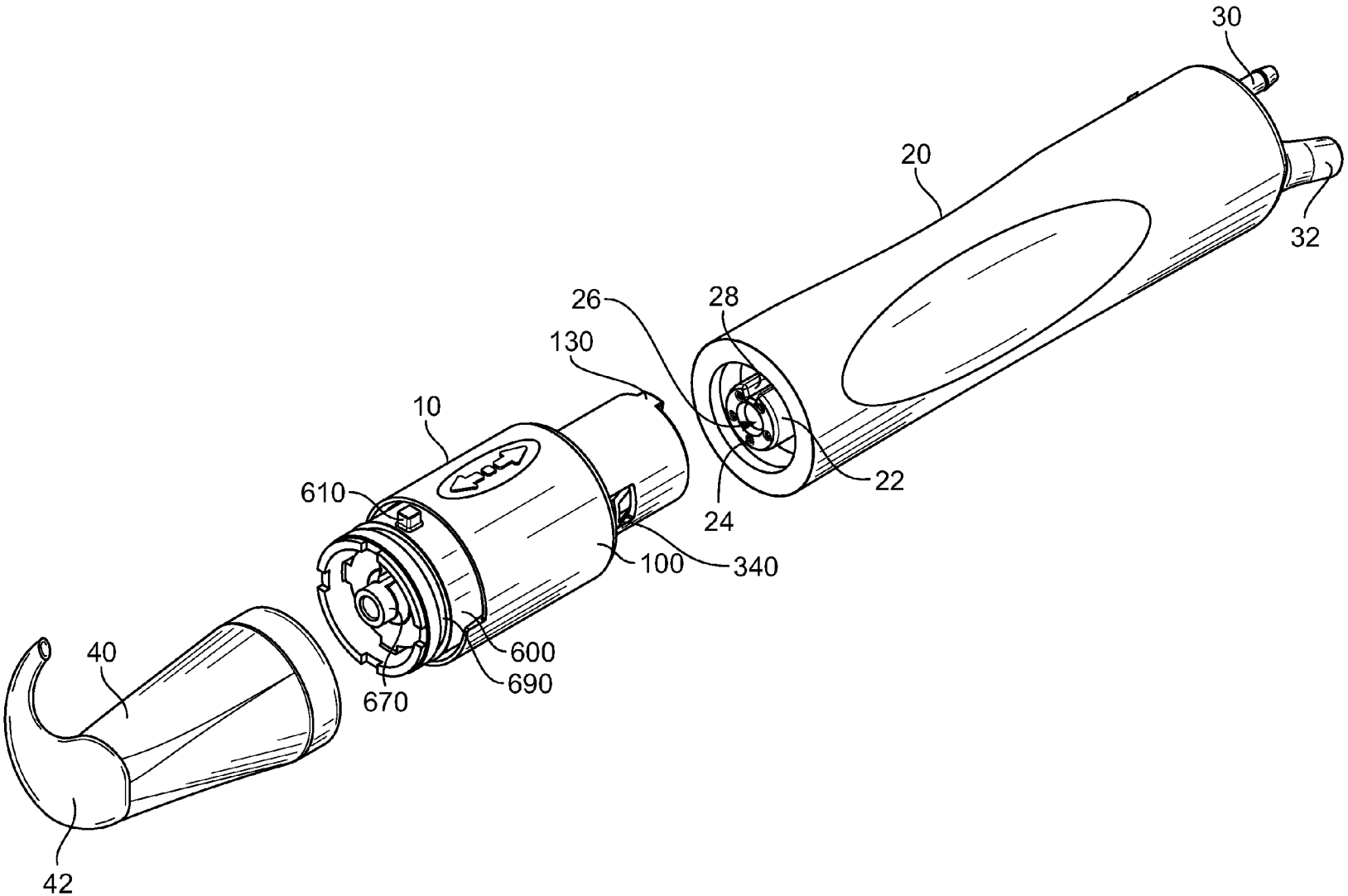
FIG. 5 illustrates the connector assembly of FIG. 1 connecting a tool to a device body.

As shown in FIG. 5 and discussed in more detail hereafter, the connector assembly 10 thus can be used to connect a tool 40 to a device body 20, which may be a tool handle, such that the tool 40 can be rotated with respect to the device body 20. This rotational adjustability of the connector assembly 10 permits a user to change the orientation of the tool head 42 while minimizing the amount of change in hand or wrist position when holding the device body 20.

Figure 2:
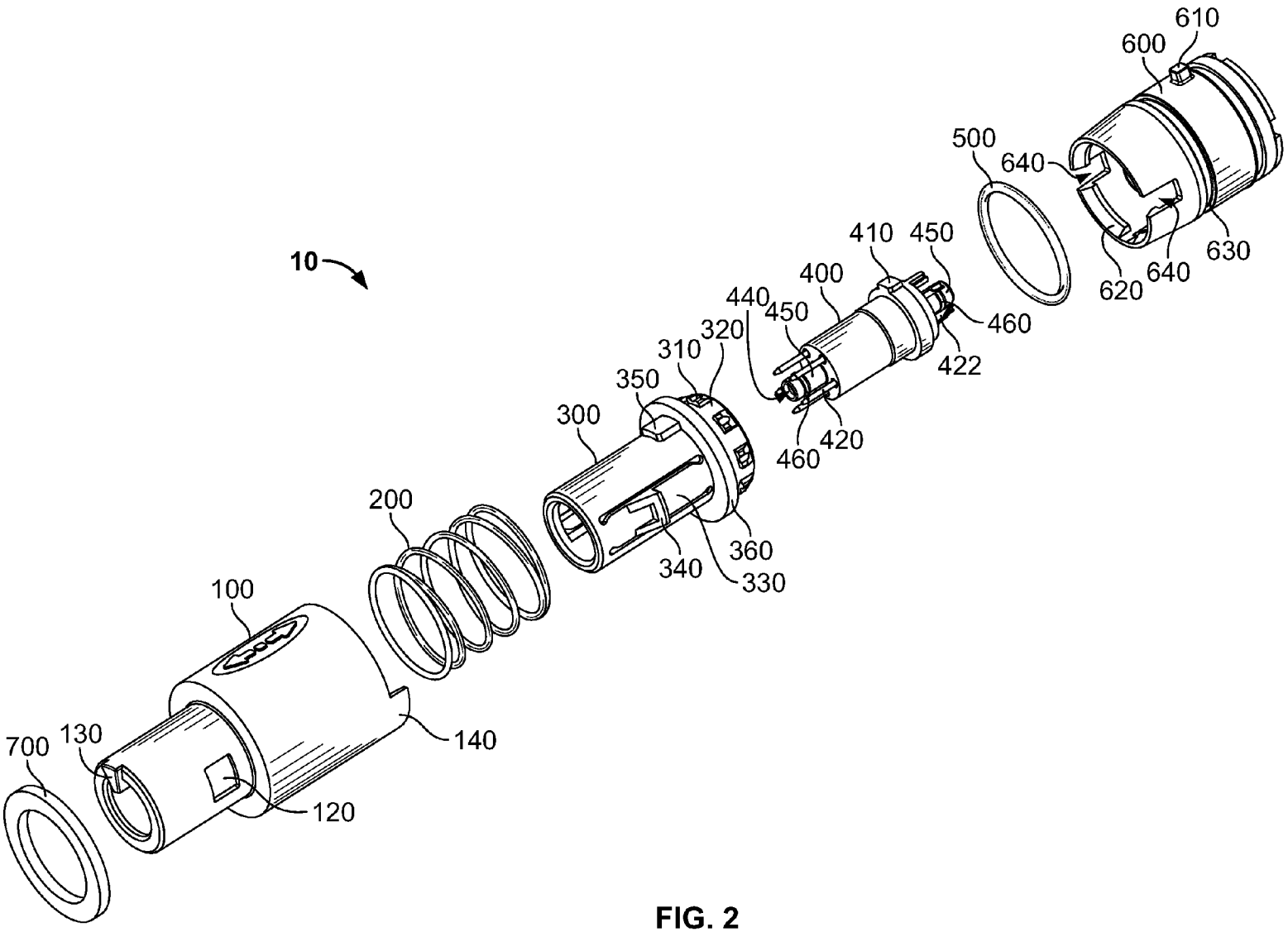
FIG. 2 illustrates an exploded view of the connector assembly of FIG. 1.

Turning to FIG. 2, an exploded version of the connector assembly 10 shown in FIG. 1 is illustrated. In addition to the connector housing 100, latch 300, and base 600, the connector assembly 10 preferably includes a plug insert 400 to accomplish an electrical connection between the tool 40 (FIG. 5) and a power source (not shown). The plug insert 400 is shown having a plurality of contacts extending axially from either side of the plug insert 400. The contacts extending toward the connector housing end of the connector assembly 10 are shown as pins 420 for insertion into corresponding sockets 24 of a receptacle insert 22 (FIG. 5).

The contacts extending toward the base end of the connector assembly 10 are shown as solder cups 422 which provide a surface to which one or more wires can be soldered. Preferably the contacts are continuous from the solder cup 422 through the plug insert 400 to the pin 420 extending from the opposite end, each contact associated with a different circuit through which power or electrical signals can be carried. It will be appreciated that any suitable contacts may be used in conjunction with the plug insert 400. It will further be appreciated that while the contacts are shown as male members extending from the plug insert 400, the contacts could be female members such as sockets extending through the plug insert 400.

In one embodiment, the connector assembly 10 has a fluid path extending internally through it to carry a fluid toward or from the tool 40 through the connector assembly 10 from or toward the device body 20. This may be achieved by providing a plug insert 400 that includes a channel 440 passing internal to the plug insert 400. The channel 440 may further be defined by fittings 450 that extend axially away from the plug insert 400 for connection to tubing or other fittings that are part of a larger fluid path on either side of the connector assembly 10. A seal 460, preferably an o-ring, can be provided on the fittings 450 to minimize the risk that liquid passing through the channel 440 will escape into the connector assembly 10, which could cause an electrical short and/or result in undesirable leakage of biohazardous material as may be present in certain surgical environments.

Figure 4:
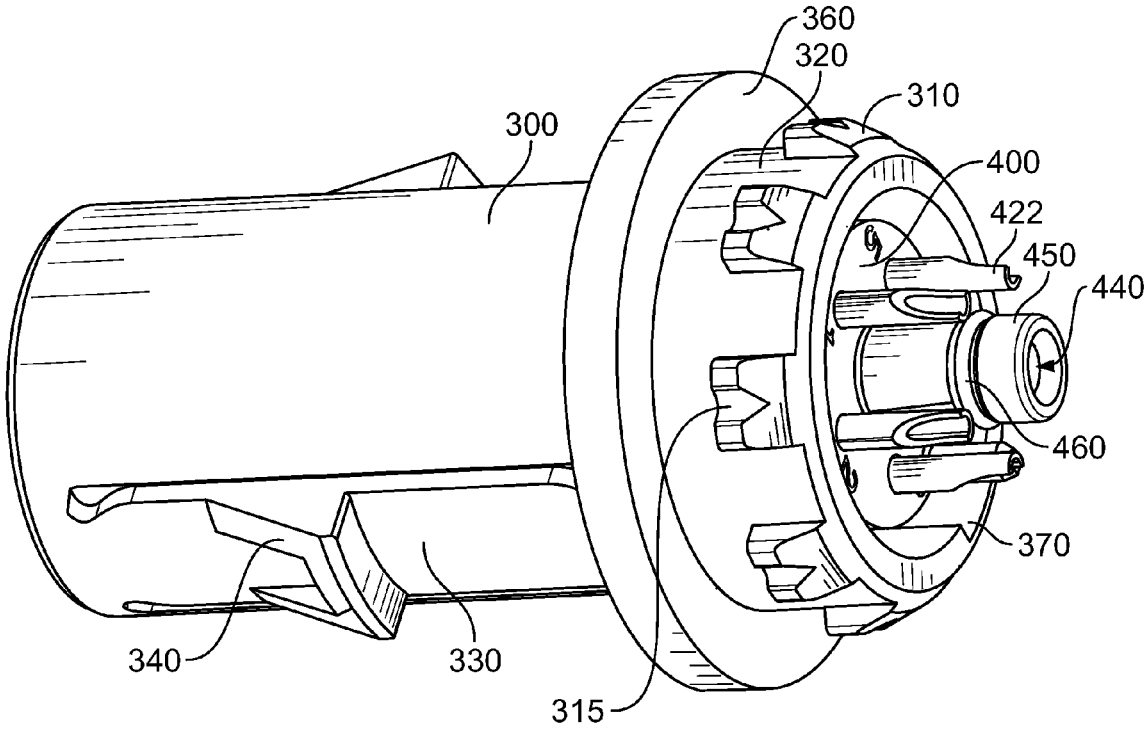
FIG. 4 illustrates a plug insert and latch subassembly for the connector assembly of FIG. 1.

FIG. 4 illustrates a subassembly in which the plug insert 400 is already positioned within the latch 300. While shown here as a subassembly, it will be appreciated that placing the plug insert 400 within the latch 300 does necessarily occur prior to other steps in forming the connector assembly 10.

Figure 6:
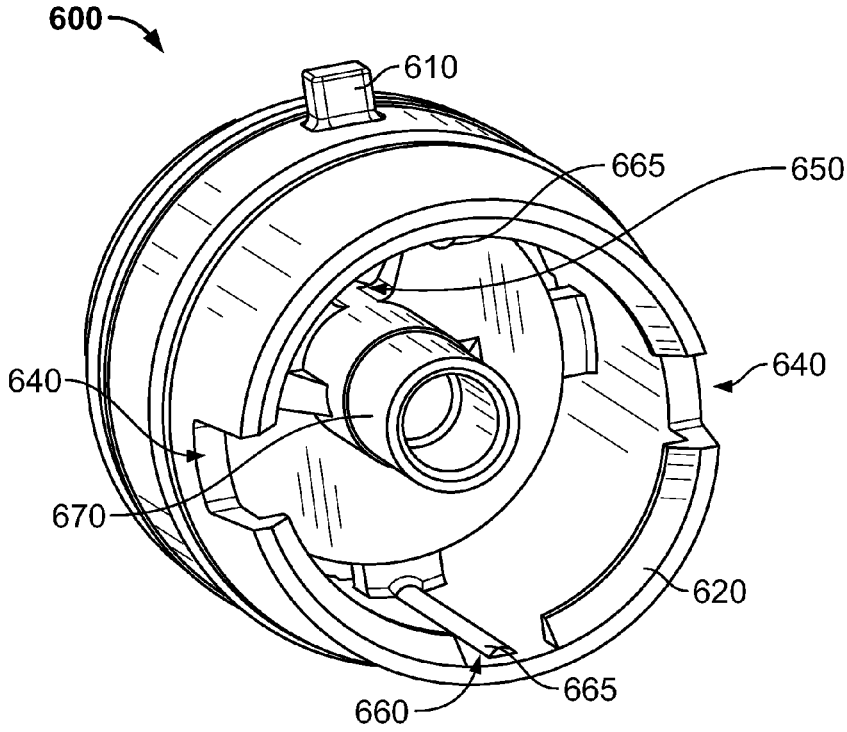
FIG. 6 illustrates an internal view of the base shown in FIG. 2.

Wires (not shown) associated with different circuits may be individually soldered or otherwise attached to the solder cups 422, which can then pass as a bundle through a cable window 650 that extends through the base 600 (best seen in FIG. 6). It will be appreciated that when wires are attached, sufficient slack should be provided so that rotating the base 600 does not strain the attachment to the solder cups 422 which, along with the plug insert 400 and latch 300, remain stationary with respect to the rotation of the base 600.

To prevent cross-connection between circuits when the connector assembly 10 is assembled, indicia such as circuit identifier numbers may be placed on the plug insert 400 adjacent each solder cup 422. It may also be desirable to incorporate a keying feature 410 (FIG. 2) in the plug insert 400 that is received in a corresponding recess 370 in the latch 300. This ensures proper alignment of the plug insert 400 with respect to the latch 300 when inserted therein and further prevents undesirable rotation of the plug insert 400 within the latch 300. The plug insert 400 may be secured within the latch 300 upon insertion. Alternatively, the plug insert 400 may be secured when the base 600 is attached to the latch 300, thereby enclosing the plug insert 400 within the latch 300 to secure it in position.

The latch 300 is secured within the connector housing 100. As illustrated in FIG. 2, this is accomplished by one or more spring beams 330 formed in the latch 300 having a retention wedge 340 extending radially away from the spring beam 330. The retention wedges 340 are compressed by the interior walls of the connector housing 100 during insertion of the latch 300 until reaching an aperture 120 in the connector housing 100. The presence of the aperture 120 removes the compression force and allows the retention wedges 340 to spring outward through the aperture 120. A vertical rear wall of the wedge 340 engages the edge of the aperture 120 which prevents rearward axial travel that might allow the latch 300 to back out of the connector housing 100.

A spring 200 may be used to provide a compliance force that urges the wedge 340 against the edge of the aperture 120 to enhance the force of the wedge against the edge of the housing aperture 120 to reduce the likelihood that the latch 300 could slip from the connector housing 100. As with the latch 300 and the plug insert 400, the connector housing 100 and the latch 300 may be keyed so that connection can occur only when the connector housing 100 and the latch 300 are at a specific orientation (such as providing a keying feature 350 that is received by a corresponding recess (not shown) in the connector housing 100). This may further ensure proper orientation of the contacts of the plug insert 400 is maintained.

In one embodiment, the base 600 is at least partially received within the connector housing 100, but attaches partially over the latch 300. The base 600 can be attached in any manner that permits the base 600 to rotate with respect to the latch 300, and thus with respect to the connector housing 100 and the plug insert 400. Preferably, the connector assembly 10 can be rotationally adjusted in predetermined increments, such as fifteen, thirty, forty-five or sixty degrees, for example. In one embodiment, the connector assembly 10 is rotationally adjustable in predetermined increments of forty-five degrees.

As better seen with respect to FIGS. 2, 4 and 6, in a preferred embodiment, the base 600 includes a wedge-shaped shelf 620 for attaching to the latch 300. The latch includes a plurality of indexing units 310 extending axially away from a base connection surface 320 of the latch 300. The indexing units 310 are spaced radially from one another at a distance to achieve the predetermined rotational increments for rotational adjustment previously described. During assembly of the connector assembly 10, as the base 600 is moved in an axial manner toward the latch 300, opposing wedge surfaces of the indexing units 310 and the shelf 620, along with one or more expansion joints 640 in the base, allow the base 600 to slide up and over the indexing units 310, with the shelf 620 locking behind the indexing units 310. Thus, after assembly, axial movement of the base 600 with respect to the latch 300 is limited or prevented entirely by the indexing units 310 and a flange 360 that may be spaced axially from one another to accommodate the width of the shelf 620. While axial movement is restricted, the base 600 can be rotated about its axis and consequently about the co-axial latch 300.

As best seen in FIG. 6, the base 600 may also include a base fitting 670 to receive the plug insert fitting 450 and further form a portion of the fluid path through the connector assembly 10.

In one embodiment, the indexing units 310 include a notch 315 (better seen in FIG. 4), while one or more ribs 665 (FIG. 6) are provided that can be received by the notches 315 and which extend axially along the inner surface 660 of the base 600. The rib(s) 665 and notches 315 are configured to prevent free rotation of the base 600 about the latch 300 so that the base 600 can be rotationally adjusted to a particular orientation in predetermined increments without slipping from that orientation. However, the retention force can easily be overcome by application of torque, such as a user twisting the base 600 with respect to the connector housing 100 and rotating it to a new position. In one embodiment, two ribs 665 are provided one hundred eighty degrees apart from one another. The use of multiple ribs 665 may enhance the stability with which the base 600 is held in a particular rotational orientation with respect to the latch 300 while still allowing that position to be easily adjusted upon the application of an external force.

Figure 7:
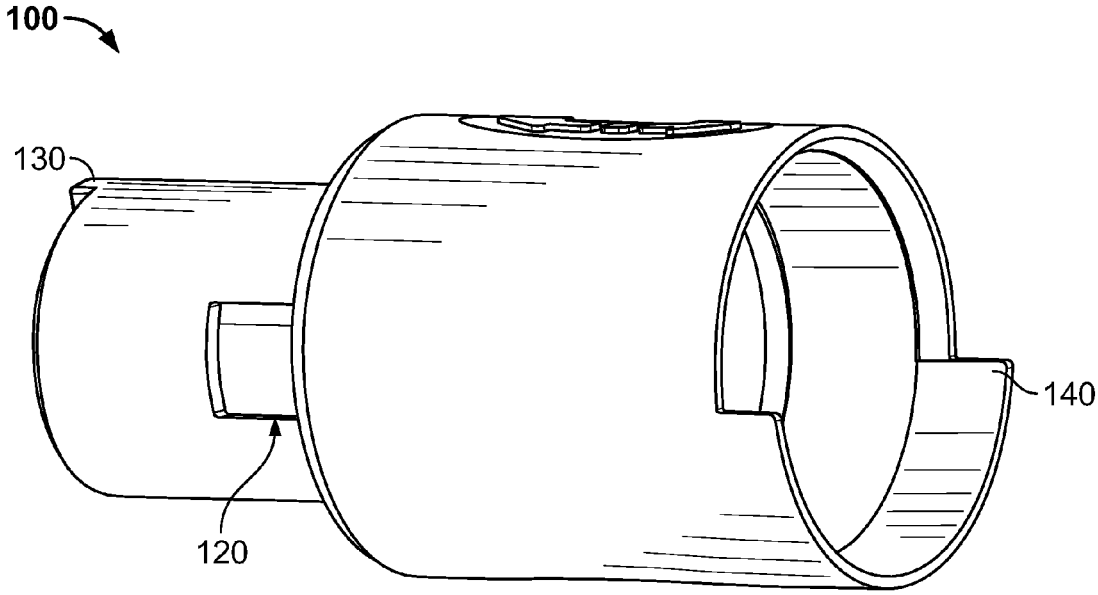
FIG. 7 illustrates an internal view of the connector housing shown in FIG. 2.

The connector assembly 10 may also establish a maximum amount of overall rotational adjustment. As shown in FIGS. 1 and 7, this may be accomplished by providing a ledge 140 that extends axially away from the connector housing 100 and a corresponding protrusion 610 that extends radially away from the base 600. As the base 600 rotates with respect to the connector housing 100, the protrusion 610 moves incrementally toward, and eventually against, the ledge 140 which prevents further rotation. In one embodiment, the rotational stop establishes a total maximum rotational adjustment of one hundred eighty degrees.

In one embodiment, the connector assembly 10 is sealed to prevent moisture external to the connector assembly 10 from migrating into it. This can be accomplished by situating an o-ring 500 (FIG. 2) or other seal in a gland 630 formed in the base 600, such that the seal is intermediate to the connector housing 100 and the base 600 in the finished connector assembly 10. An interfacial seal 700 may also be provided intermediate to the connector housing 100 and the device body 20 to which the connector assembly 10 is connected. The interfacial seal, if provided, is preferably made of a foam or other resilient, compressible material, which may aid in the connection between the device body 20 and the connector assembly 10.

Figure 3:
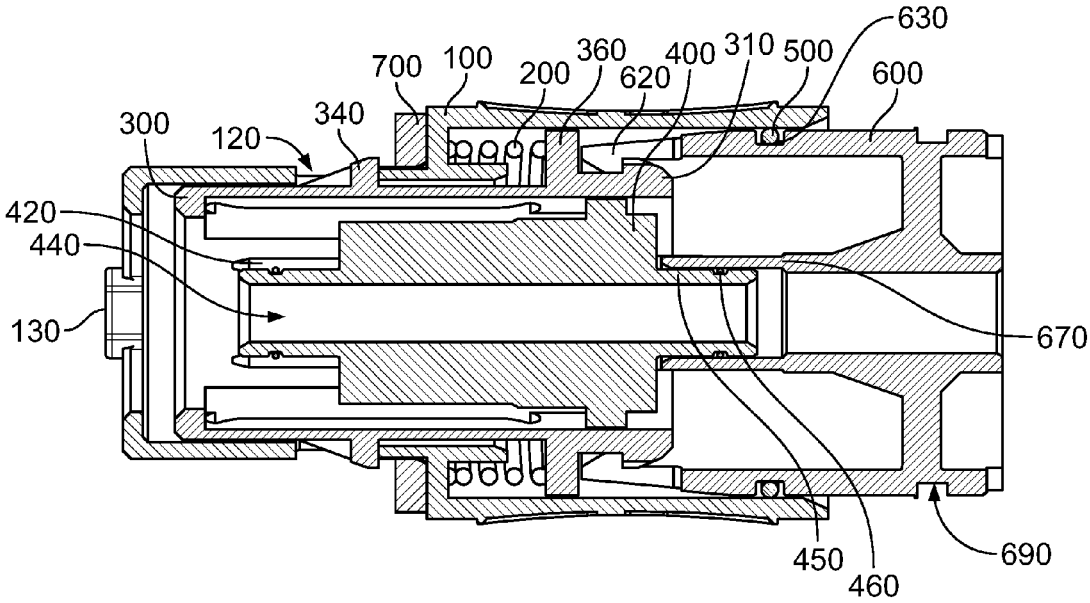
FIG. 3 illustrates a cross-sectional view of the connector assembly of FIG. 1 taken along a horizontal plane that includes line 3-3.

Turning to FIG. 3, a sectional view of the fully assembled connector assembly 10 is shown. FIG. 3 illustrates the plug insert 400 situated inside the latch 300. The latch 300, in turn, is connected at a fixed position with respect to the connector housing 100, with the retention wedges 340 protruding from the housing apertures 120. The spring 200 pushes against the flange 360, urging the rear wall of the retention wedges 340 against the side of the housing aperture 120, which further helps the wedges 340, and thus the entire latch 300, from unintentionally slipping from the connector housing 100. The base shelf 620 locks behind the indexing unit 310 and in front of the flange 360, preventing axial movement of the base 600 with respect to the latch 300, but permitting rotational movement as previously described.

Components of the connector assembly 10 can be manufactured by any suitable technique from any suitable material. The connector housing 100, latch 300, base 600 and plug insert 400 are generally injection molded from medical grade thermoplastic materials. The components of the connector assembly 10 may be provided in kit form for subsequent assembly.

Turning to FIG. 5, the connector assembly 10 may be used to connect a tool 40 directly or indirectly with a power source or other instrumentation via a device body 20. The tool can be any tool and in medical applications may be a scalpel, cauterizer, or similar device, for example.

As illustrated, the base 600 forms a first end of the connector assembly 10 that can receive the tool 40, including a tool head 42 or other working feature having a fixed orientation. Any wires extending from the cable window 650 in the base 600 (FIG. 6) can be connected to the tool 40 during final tool assembly, for example. The tool 40 may be physically attached to the connector assembly, for example, by engaging a radial groove 690 formed in the base or by any other suitable means for securing the tool 40 to the connector 10 assembly.

The connector housing 100 forms a second end of the connector assembly 10 that can be inserted into a receptacle insert 22 to complete the electrical circuit between the tool and the power source or instrumentation. The receptacle insert 22 may be formed integral with the device body 20 or may be a separate component that fits within or otherwise attaches to the device body 20. The pins 420 from the plug insert 400 positioned within the connector assembly 10 extend into corresponding sockets 24 in the body receptacle 22, while the plug insert fitting 450 can be received in a body passage 26 to continue a sealed internal passage for liquid which can be extracted through a fluid outlet 30 in the device body 20, which may, for example, be connected to a vacuum. Likewise, the sockets 24 can be connected via an external power source or instrumentation via a cable outlet 32. The receptacle insert may have a channel 28 or other device to receive a keying feature 130 formed in the connector housing 100 of the connector assembly 10. The connector housing 100 may further be retained within the device body, for example, by an undercut (not shown) in the device body 20 that engages the wedges 340 protruding through the apertures 120 in the connector housing 100.

It will be appreciated that while different aspects of the invention have been discussed as having male or female configurations for achieving physical and/or electrical contact, the configurations could be reversed, or other types of configurations for mating two parts could be used instead.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A rotationally adjustable connector assembly comprising:

a connector housing;

a base; and a latch connected to the connector housing and the base, wherein the latch is connected at a fixed position with respect to the connector housing and wherein the base is co-axial with the latch, the base and the latch being configured to permit the base to rotate about the latch, such that the base is thereby rotationally adjustable with respect to the connector housing, wherein the connector assembly further comprises an enclosed sealed channel to provide a fluid path passing internal to the connector assembly.

2. The connector of claim 1, wherein the latch is configured to permit the base to rotate about the latch in predetermined increments.

3. The connector assembly of claim 2, wherein the base comprises an axially extending rib along an inner surface and wherein the latch comprises a plurality of radially spaced indexing units extending away from the latch, the indexing units having a notch therein to receive the axial rib and thereby establish an increment for rotation.

4. The connector assembly of claim 1, wherein the connector assembly further comprises a spring internal to the connector housing that exerts a compliance force to urge the latch toward its fixed position with respect to the connector housing.

5. The connector assembly of claim 1, further comprising a plug insert positioned within the latch, the plug insert having a plurality of contacts for accomplishing an electrical connection between a tool attached to a first end of the connector assembly and a device body attached to a second end of the connector assembly.

6. The connector assembly of claim 1, further comprising a seal internal to the connector assembly intermediate to the connector housing and base.

7. The connector assembly of claim 1, further comprising means for establishing a maximum angle of rotation of the base with respect to the connector housing.

8. The connector assembly of claim 1, wherein the connector assembly comprises a plug insert having a plurality of contacts arranged in a circular manner and wherein the plug insert further has a fitting extending axially away from the plug insert, the fitting defining a channel extending internally through the plug insert.

9. The connector assembly of claim 1, wherein the latch is keyed for connection with the connector assembly in a single orientation.

10. A rotationally adjustable connector assembly comprising:

a connector housing;

a base;

a latch connected to the connector housing and the base;

a plug insert positioned within the latch, the plug insert having a plurality of contacts for accomplishing an electrical connection between a tool attached to a first end of the connector assembly and a device body attached to a second end of the connector assembly; and an enclosed channel to provide a fluid path passing internal the connector assembly, wherein the latch is connected at a fixed position with respect to the connector housing and wherein the base is co-axial with the latch, the base and the latch being configured to permit the base to rotate about the latch in predetermined increments, such that the base is thereby rotationally adjustable with respect to the connector housing.

11. The connector assembly of claim 1, wherein the plug insert comprises a fitting extending axially away from the plug insert to at least partially define the enclosed channel.

12. The connector assembly of claim 11 further comprising a seal positioned on the fitting.

13. The connector assembly of claim 10 further comprising a seal positioned within the connector assembly positioned intermediate to the base and the connector housing.

14. The connector assembly of claim 10, wherein the base has a maximum angle of rotation with respect to the connector housing.

15. The connector assembly of claim 10, wherein the base comprises an axially extending rib along an inner surface and wherein in the latch comprises a plurality of radially spaced indexing units extending away from the latch, the indexing units having a notch therein to receive the axial rib and thereby establish an increment for rotation.

16. The connector assembly of claim 10, wherein the latch comprises a flange extending radially away from the latch and wherein the connector assembly further comprises a spring positioned intermediate to the flange and an internal wall of the connector housing, the spring positioned to urge the latch toward its fixed position with respect to the connector housing.

17. A kit comprising a connector housing;

a base;

a latch connectable with each of the connector housing and the base;

means for connecting the latch to the connector housing to maintain the latch at a fixed position with respect to the connector housing; and means for connecting the base to the latch to permit rotation of the base about the latch along a common axis in predetermined increments, wherein the means for connecting the latch to the connector housing comprises a spring beam formed in the latch having a retention wedge extending axially away from the latch and an aperture in the connector housing to receive the retention wedge.

18. The kit of claim 17 wherein the means for connecting the base to the latch comprises a shelf formed around an inner surface of the base, a rib extending axially along the inner surface of the base, a plurality of indexing units extending radially away from the latch and a notch formed in the indexing units to receive the rib from the base.

* * * * *